United States Patent [19]

Giebeler

[11] 4,050,512

[45] Sept. 27, 1977

[54] STROKE ACTUATED WELL TESTING TOOL

[75] Inventor: Bernhardt F. Giebeler, San Bernardino, Calif.

[73] Assignee: BJ-Hughes Inc., Long Beach, Calif.

[21] Appl. No.: 702,406

[22] Filed: July 6, 1976

[51] Int. Cl.[2] ..... E21B 49/00

[52] U.S. Cl. ..... 166/128; 166/131; 166/133; 166/240; 166/334

[58] Field of Search ..... 166/126, 131, 133, 334, 166/128, 150, 184, 240, .5, 188, 169

[56] References Cited

U.S. PATENT DOCUMENTS

| | | | |
|---|---|---|---|
| 1,909,589 | 5/1933 | Mack | 166/188 |
| 2,129,216 | 9/1938 | Johnston | 166/184 |
| 3,347,318 | 10/1967 | Barrington | 166/150 |
| 3,414,059 | 12/1968 | Nutter | 166/131 |
| 3,494,419 | 2/1970 | Mullins | 166/150 |
| 3,900,068 | 8/1975 | Scott | 166/.5 |

*Primary Examiner*—James A. Leppink
*Attorney, Agent, or Firm*—Lyon & Lyon

[57] ABSTRACT

A stroke actuated well testing tool carried by a tubing string and including a packer, radial ports for maximum internal flow past the packer, and a valve controlling flow through the tubing string; the tool further including radial port control assemblies which are relatively movable axially, when the packer and tool are set, to close the radial ports, and valve control assemblies which are relatively movable to open and close the valve; the radial port control assemblies including a fluid flow restrictor to provide a time delay thereby to permit relative movement of the valve control assemblies without operation of the port control assemblies; the tool further including at least one annular sample collecting pressure resistant chamber occupying an open position for receiving well samples when the packer is set and a closed position when the tool is being pulled out.

6 Claims, 45 Drawing Figures

"S"=SET CONDITION
"R"=RUNNING CONDITION

STROKE ACTUATED WELL TESTING TOOL

BACKGROUND

When it is desired to test the potential flow from a well, a packer and valve assembly is lowered on a tubing string, the packer is set and the valve is opened for flow to the well surface. Usually the valve forms a constriction preventing a full flow test. If, in addition, bottom hole samples of the static well condition are required, a sampler is lowered on a wire line; however the capacity of such sampler tool requires that well flow through the tubing string be maintained, which may not be desirable.

SUMMARY

The present invention is directed to a stroke actuated well testing tool and is arranged to overcome the indicated difficulties encountered with conventional testing tools, and is summarized in the following objects:

First, to provide a stroke actuated well testing tool wherein a sliding unloader valve including means requiring the application of axial force applied through the tubing string for a predetermined interval to effect movement between its open or closed positions so that axial force may be applied for a shorter interval for other purposes without changing the condition of the unloader valve.

Second, to provide a stroke actuated well testing tool, as defined in the preceding object, which includes a packer and novel means for setting the packer while manipulating the unloader valve to its closed position so that fluid pressure existing between the well bore and tubing string is available to maintain the packer in its sealed condition while the tubing string is moved axially to effect operation of the testing tool.

Third, to provide a stroke actuated well testing tool, as indicated in the other objects, which includes a sampler assembly one or more of which may be used to collect well samples in annular chambers which are open to the interior of the tool when the tool is set, the sampler chambers being arranged to close when force is applied to effect unseating of the packer assembly.

Fourth, to provide a well fluid sampler, as indicated in the preceding object, wherein the sampler chambers when sealed are capable of maintaining the samples under bottom hole pressure for delivery to the well head, the sampler chambers being provided with externally accessible valves for determining the pressure and removing the contents of the sampler chambers.

Fifth, to provide a well fluid sampler which includes a rotary block valve and actuating means therefor for opening or closing off flow through the tubing string, the rotary block valve being turned between its open and closed positions by reciprocation of the tubing string and valve actuating means without unseating the packer, the rotary block valve having a bore equal to the bore of the tubing string as well as the bore of the sampler tool.

DESCRIPTION OF THE FIGURES

FIGS. 1 and 2 are consecutive side views of the stroke actuated well testing tool shown in its set condition.

FIGS. 3S through 10S are consecutive longitudinal half-sectional views showing the testing tool in its set condition.

FIGS. 3R through 10R are consecutive longitudinal half-sectional views corresponding respectively to FIGS. 3S through 10S showing the testing tool in its running in and pulling out condition.

DETAILED DESCRIPTION

Figures 1, 2, 3R, 3S, 4R, 4S:
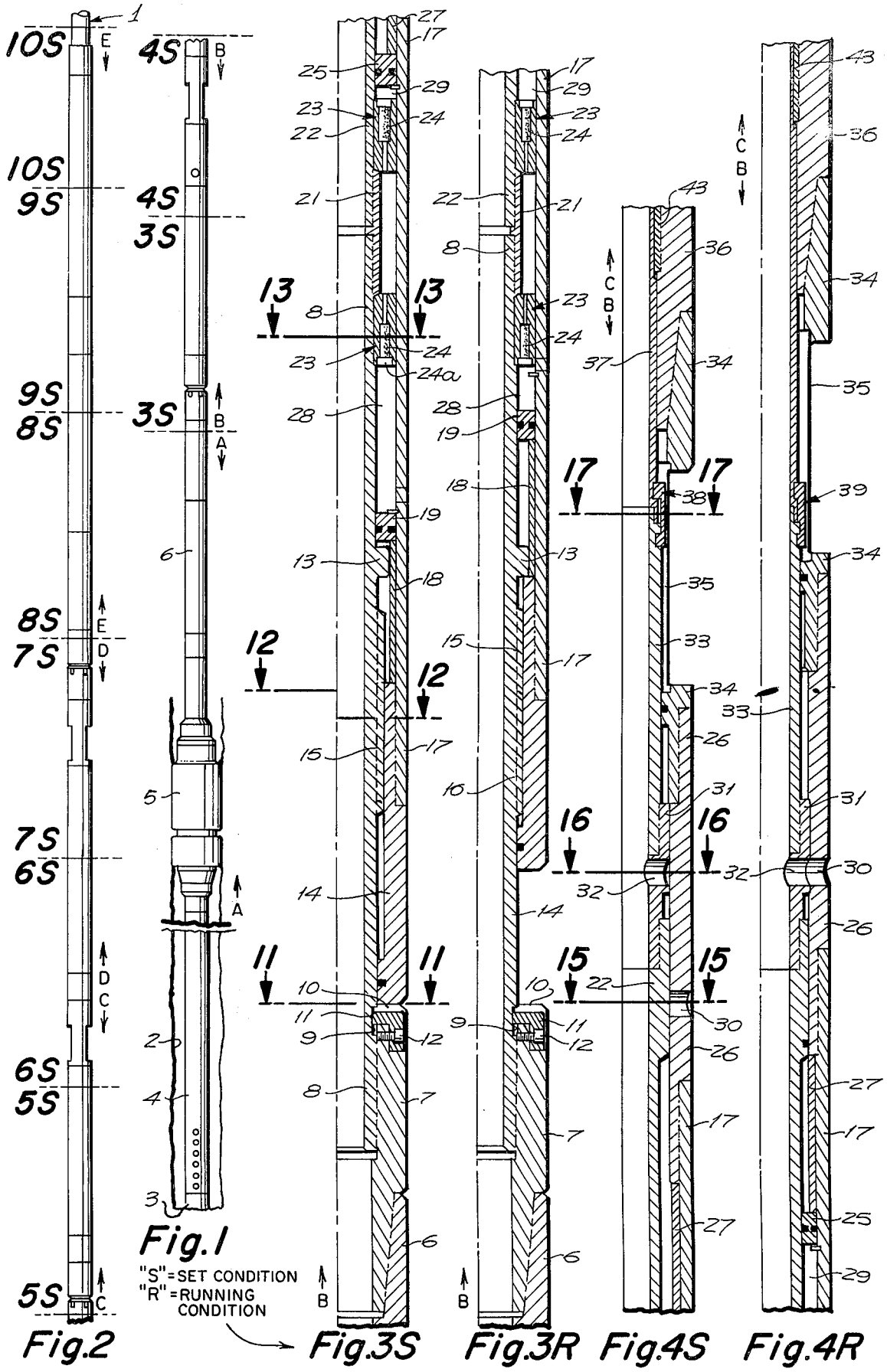
Figures 5R, 5S, 6R, 6S, 7R, 7S:
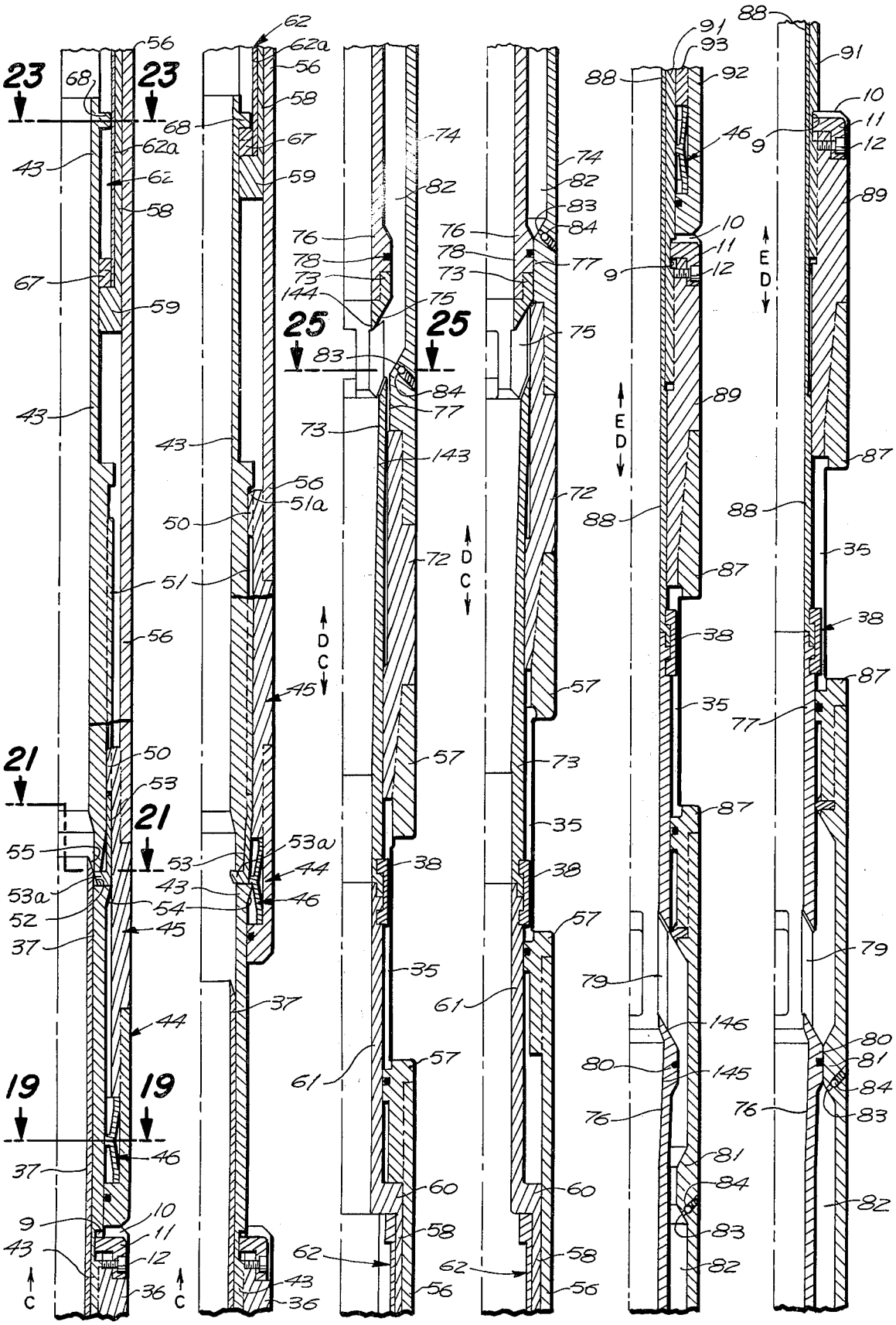
Figures 8R, 8S, 9R, 9S, 10R, 10S:
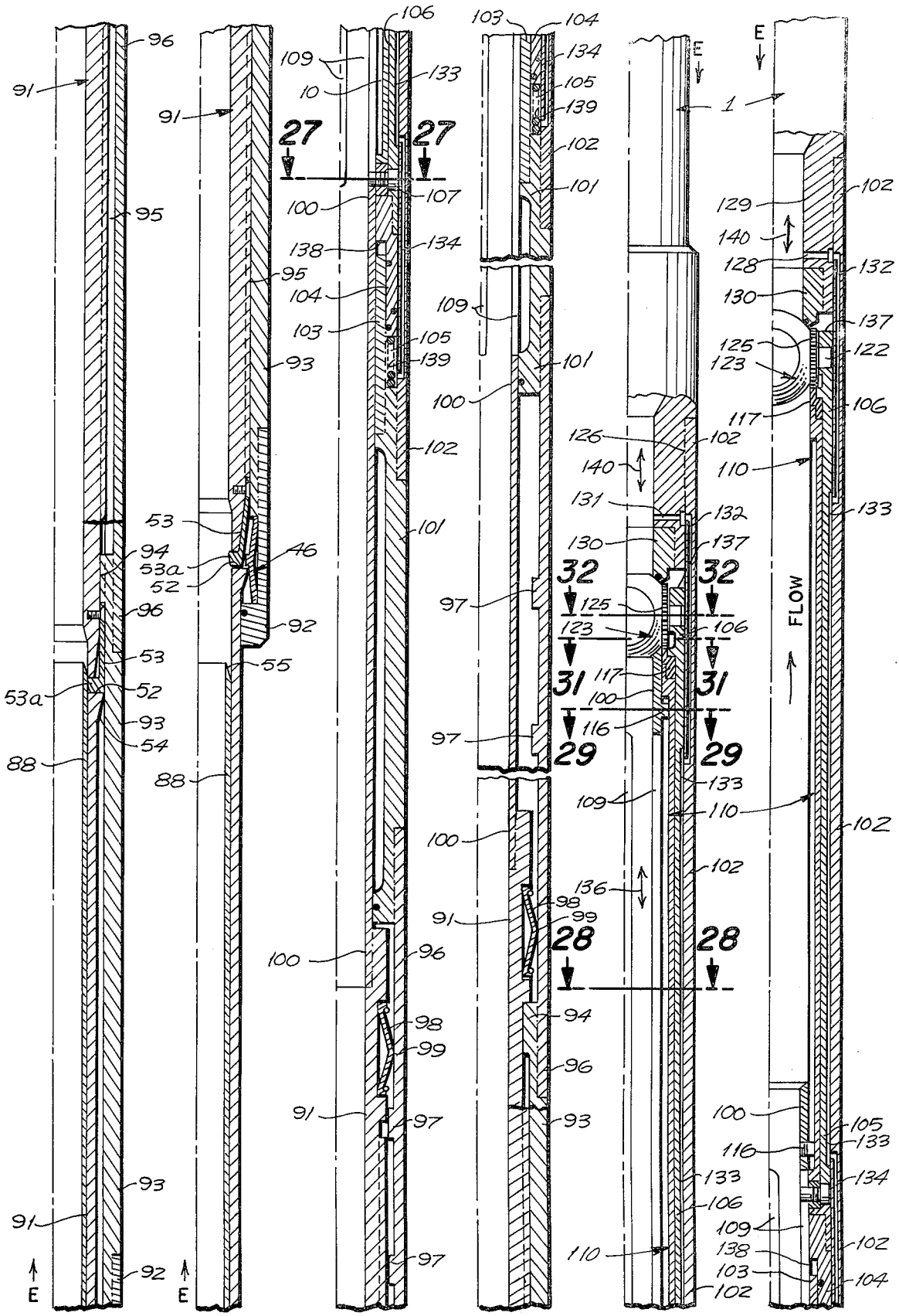

The stroke actuated well testing tool includes a packer assembly A located between A—A of FIG. 1, an unloader assembly B located between B—B of FIG. 1 and also between B—B of FIGS. 3S and 4S, as well as FIGS. 3R and 4R; an interlocking assembly C located between C—C of FIG. 2 and also between C—C of FIGS. 5S and 6S, as well as C—C of FIGS. 5R and 6R; a sampler assembly D located between D—D of FIG. 2 and between D—D of FIGS. 6S and 7S, as well as FIGS. 6R and 7R; and a stroke actuated valve assembly E located between E—E of FIG. 2 and between E—E of FIGS. 8S and 10S, as well as between FIGS. 8R and 10R.

The upper end of the testing tool is supported from a tubing string 1. The well testing tool and tubing string is adapted to be lowered in a well bore 2 to the bottom 3 thereof or at any other selected level.

The packer assembly A includes a perforated bottom tube 4, a conventional packer 5 and a connecting tube 6.

The bypass assembly B is provided with an adjustable fitting 7 which is screwthreaded to the upper end of the tube 6 and is also screwthreaded to a mandrel 8. Because of the necessary small size of the drawings the screwthread connections are indicated by broken lines. The screwthread connections are conventional and include appropriate conventional sealing means and if need be, torque locking means, not shown.

Figure 11:
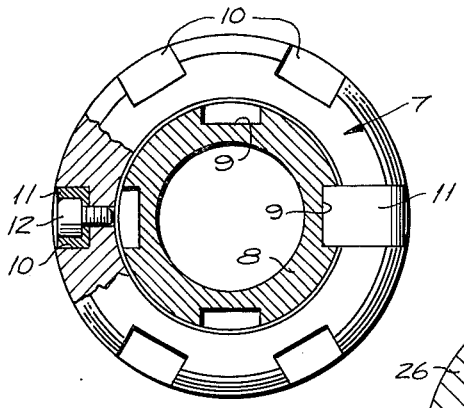
FIGS. 11 through 17 are enlarged transverse sectional views taken respectively at 11—11 through 17—17 of FIGS,. 3S and 4S.

Referring to FIGS. 3S, 3R and 11, it is desirable to provide axial adjustment between the fitting 7 and the mandrel 8. For this purpose the mandrel is provided with a set of circumferentially spaces recesses 9 and the fitting is provided with end slots 10. The mandrel and fitting are relatively secured by locking lugs 11 held in place by screws 12.

Figure 12:
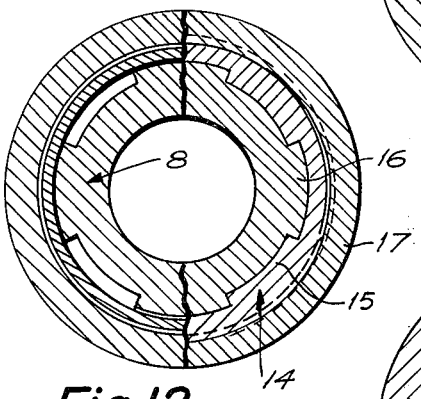

Slidably movable between the upper end of the fitting 7 and a stop flange 13 provided on the mandrel 8 is an annular external body 14 having, above the stop flange 13, a set of internal splines 15 disposed between external splines 16 provided on the mandrel 8 so that the two members are interlocked against relative rotation, as shown in FIG. 12.

The body 14 is screwthreaded to an external body 17 having the same external diameter. Interposed between the body 17 and mandrel 8, outwardly of the stop flange 13, is a spacer sleeve 18 and a seal ring 19, the later located above the stop flange 13.

Figure 13:
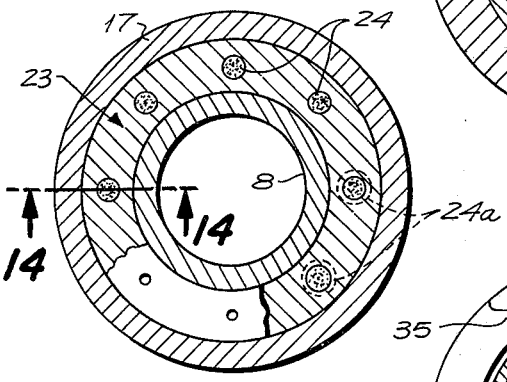
Figure 14:
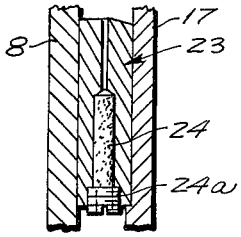

The mandrel 8 is joined by an external coupling 21 to a second mandrel 22. Secured to the mandrels 8 and 22 at opposite sides of the coupling 21 is a pair of flow restricting pistons 23, the details of which are shown in FIGS. 13 and 14 each piston is provided one or more flow restricting cells 24 formed of fibers or granular material held in place by a tubular screw 24a. Above the upper piston 23 is a seal ring 25.

The body 17 extends sbove the seal ring 25, as shown in FIGS. 4S and 4R, and is joined by screwthreads to an external body 26 having an external diameter corresponding to the body 17. A spacer sleeve 27 is interposed between the seal ring 25. The body 17 and mandrels 8 and 22 form between the pistons 23 and seal rings 19 and 25 a lower pressure chamber 28 and an upper pressure chamber 29, which are initially filled with oil through suitable access openings in the body 17 closed by screwthreaded plugs, not shown.

Figure 15:
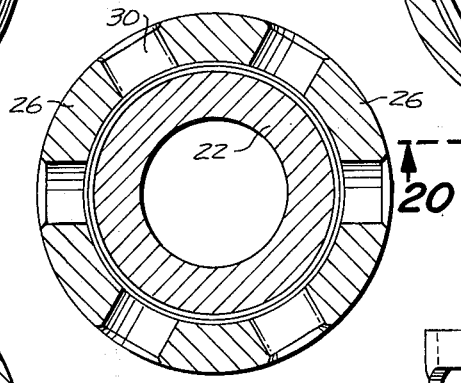
Figure 16:
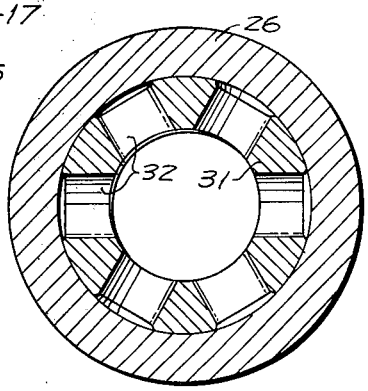

As indicated in FIGS. 4S, 4R and 15, the valve body 26 is provided with a ring of ports 30. Secured to the upper end of the mandrel 22 is a valve sleeve 31 having a ring of ports 32, indicated in FIG. 16. The valve sleeve 31 also serves as a coupling between the mandrel 22 and an additional mandrel 33.

The valve body 26 is internally screwthreaded to an access body 34 having a pair of diametrically disposed access windows 35, as indicated in FIG. 14. The upper end of the mandrel 33 is accessible through the windows 35. The upper ends of the mandrel 33 and the access body 34 constitute the upper end of the bypass assembly B.

The upper end of the access body 34 is joined by screwthreads to an adjustable fitting 36 similar to the fitting 7. The adjustable fitting 36 forms the lower end of the interlocking assembly C.

The upper end of the mandrel 33 is joined to a control sleeve 37 by means of a separable connector 38. The connector 38, as shown in FIGS. 4S and 4R, is shown as a single piece ring due to the small scale of the drawing. The connector is more fully illustrated in FIGS. 17 and 18. To accommodate the connector the mandrel 33 and sleeve 37 are provided with annular grooves 39 and 40 which receive a split ring 41 having mating internal flanges, the split ring is held in place by a cover sleeve 42 secured by one or more screws 42a.

The upper end of the adjustable fitting 36 is connected by internal screwthreads to a mandrel 43 which receives the upper portion of the control sleeve 37. The mandrel 43 and fitting 36 are adjustably secured together in the same manner as the fitting 7 and mandrel 8; that is, the mandrel 43 is provided with recesses 9, the adjustable fitting is provided with end slots 10 interconnected by locking lugs 11 secured by screws 12, as shown in FIG. 11.

Figure 19:
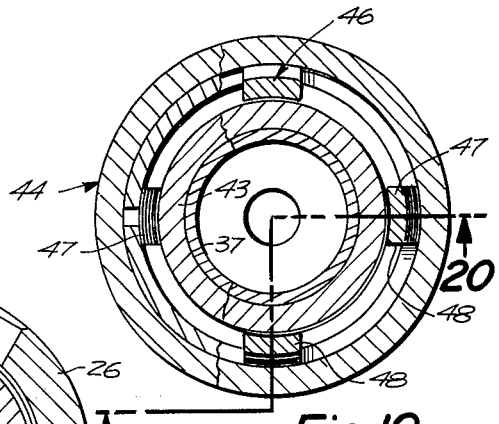
FIG. 19 is an enlarged transverse sectional view taken through 19—19 of FIG. 5S.
Figure 20:
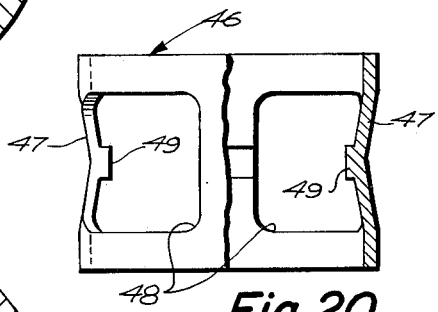
FIG. 20 is a partial side view partial sectional view of a lock ring utilized in the testing tool taken through 20—20 of FIG. 19.

Slidably fitting the mandrel 43 above the adjustable fitting 36 is a lock ring sleeve 44 joined by internal screwthreads to a body 45, forming with the sleeve 44 an annular retainer chamber for a lock ring 46, the details of which are shown in FIGS. 19 and 20. The lock ring includes a set of circumferentially spaced spring webs 47 separated by slots 48, centered with respect to each spring web is an internally directed locking boss 49.

Figure 21:
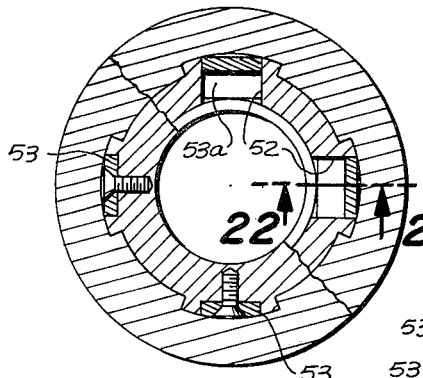
FIG. 21 is an enlarged transverse sectional view taken through 21—21 of FIG. 5S.
Figure 22:
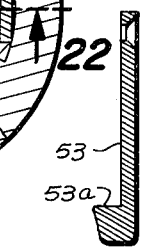
FIG. 22 is a longitudinal sectional view of a latch finger utilized in the testing tool taken through 22—22 of FIG. 21.

The upper end of the body 45 is provided with internal splines 50 which engage external splines 51 provided on the mandrel 43. Adjacent the lower ends of the external splines 51, the mandrel 43 is provided with a set of circumferentially spaced radial slots 52, as shown in FIG. 21. Secured to the mandrel above the slots is a set of fingers 53 having inturned lower ends **53*a* which are movable radially in the slots. Immediately below the slots the mandrel is provided with an upwardly diverging deflecting ramp 54. The control sleeve includes a beveled upper end 55 having an upper position underlying the slots 52 to force the fingers 53 outward and a lower position clearing the slots as indicated in FIGS. 5S and 5R**.

The body 45 is externally screwthreaded to an elongated body 56 which in turn is connected by internal screwthreads to an excess body 57, similar to the access body 34 and is provided with access windows 35.

Figure 23:
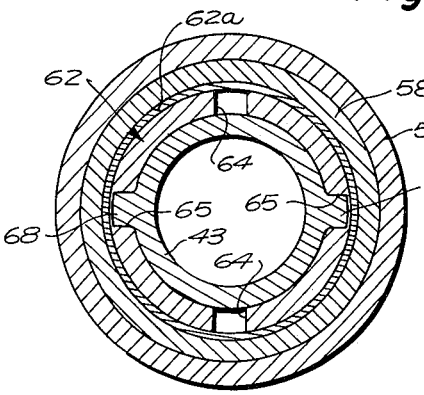
FIG. 23 is an enlarged transverse sectional view taken through 23—23 of FIG. 5S.
Figure 24:
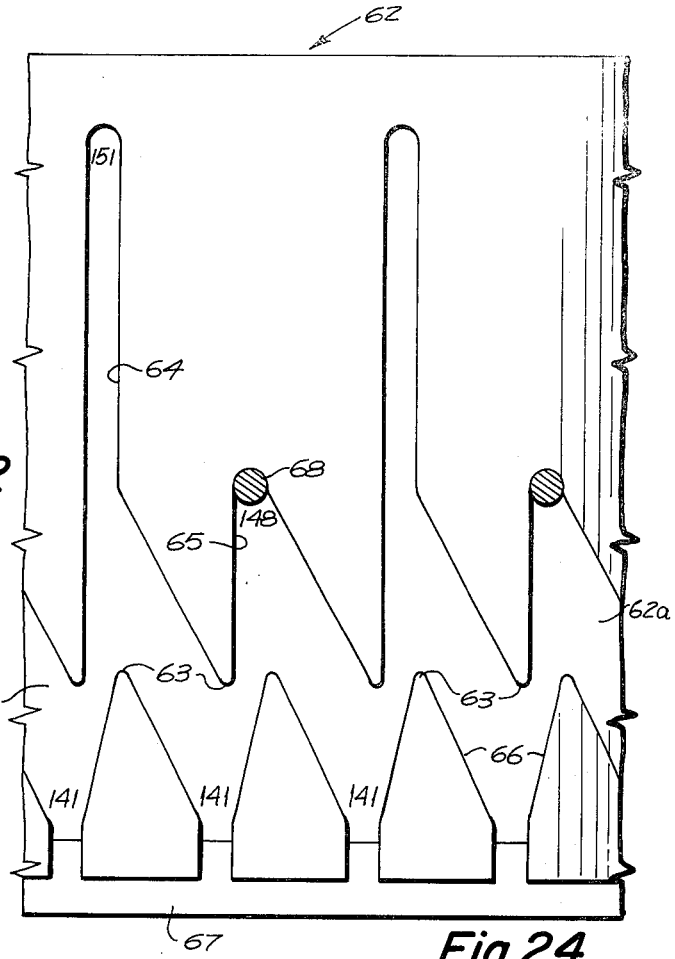
FIG. 24 is an enlarged developed view of a cam unit for control of a bleed port utilized by the testing tool.

Axially movable between the access body 57 and the upper portion of the mandrel 43 is a cam housing 58, as indicated in FIG. 23. The cam housing is provided at its lower end an internal flange 59 and the upper end of the housing 58 is attached to an external flange 60 provided at the lower end of a mandrel 61. Within the cam housing and restrained between the flanges 59 and 60 is an indexing cam sleeve 62 shown particularly in FIGS. 23 and 24. As shown in FIG. 24 the cam sleeve includes axially overlapping index cam tips 63 which form the apex ends of alternately disposed major longitudinal slots 64 and minor longitudinal slots 65 directed upwardly therefrom and a series of indexing V slots 66 directed downwardly therefrom. The lower ends of the cam slots 66 are closed by a closure ring 67. The segmental portions of the cam sleeve 62 are suitably secured to a mounting shell **62*a*. Adjacent its upper end the mandrel 43 is provided with a pair of diametrically disposed cam follower pins 68 which project outwardly from the mandrel. The upper ends of the body 57 and mandrel 61** constitute the upper portions of the interlocking assembly C.

Figure 17:
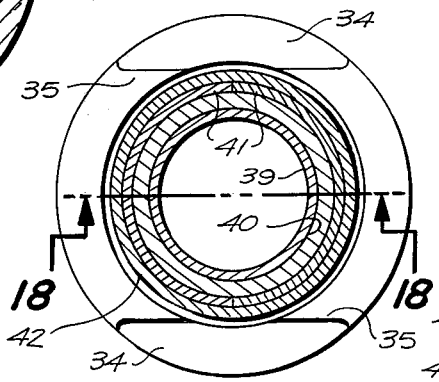
Figure 18:
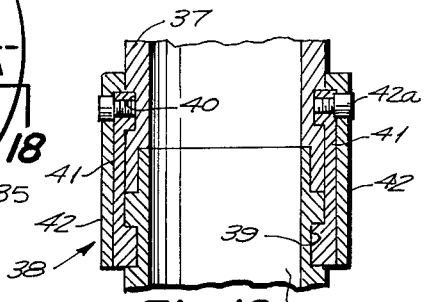
FIG. 18 is a fragmentary longitudinal sectional view showing a coupling means taken through 18—18 of FIG. 17.

The access body 57 is joined to an end fitting 72 and the mandrel 61 is removably connected to a mandrel 73 by a separable connector 38, as shown in FIGS. 17 and 18. The end fitting 72 and mandrel 73 form the lower members of the well fluid sample assembly D.

Figure 25:
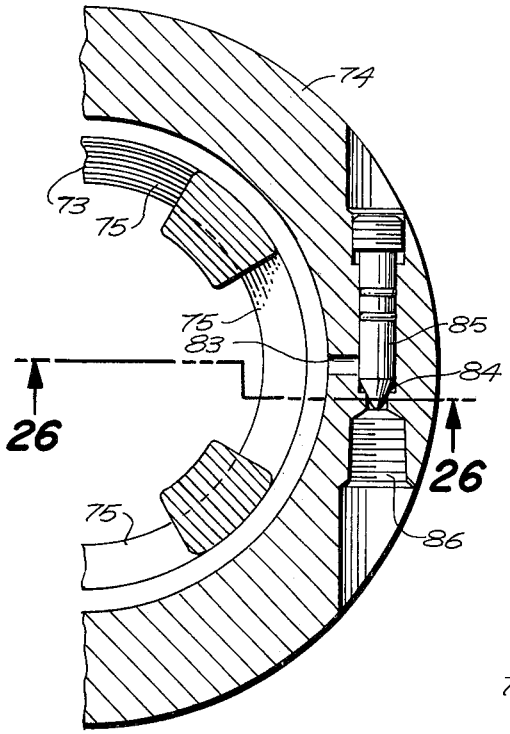
FIG. 25 is a substantially enlarged half-sectional view taken through 25—25 of FIG. 6S.
Figure 26:
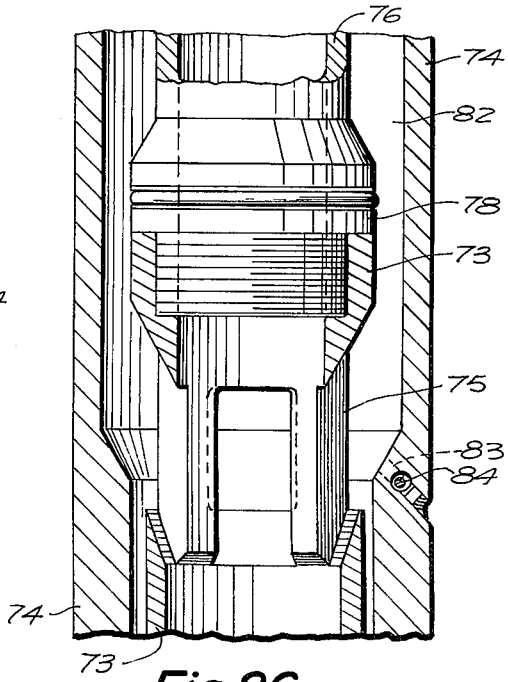
FIG. 26 is a fragmentary longitudinal view at a reduced scale taken through 26—26 of FIG. 25.
Figure 29:
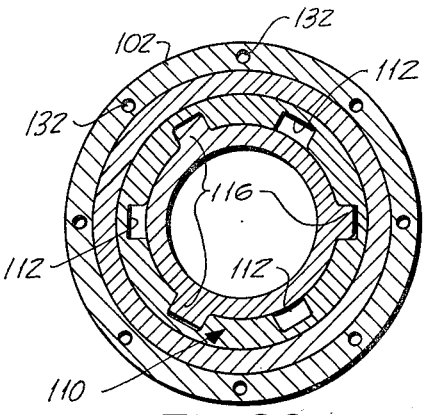
FIGS. 28 and 29 are enlarged transverse sectional views taken through 28—28 and 29—29 of FIG. 10S.
Figure 28:
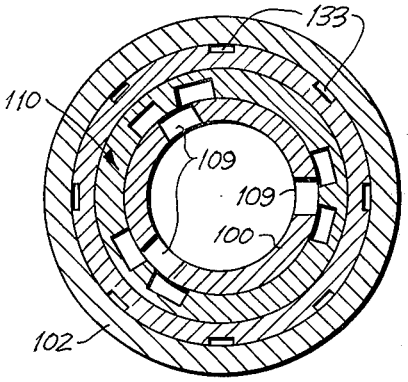

Secured to the fitting 72 and extending upwardly beyond the mandrel 73 is a sampler outer sleeve 74, the upper portion of the mandrel 73 is provided with a set of peripherally spaced entrance slots 75 which diverge upwardly, as shown in FIGS. 25 and 26. The upper end of the mandrel 73 is screwthreaded to a sampler inner mandrel 76. The lower end portions of the outer and inner sampler sleeves have respectively a lower internal seal flange 97 and a lower external seal flange 78. As shown in FIG. 6S, the seal flanges are spaced by the entrance slots 75 when the sampler is open and as shown in FIG. 6R, these seal flanges are in mutual engagement when the sampler is closed.

Spaced upwardly from the entrance slots 75 a substantial distance, is a set of exit slots 79 formed in the mandrel 73 and converging upwardly. Immediately below the exit slots 79, the mandrel 76 is provided with an upper external seal flange 80, spaced below the upper external seal flange in correspondence with the spacing between the seal flanges 77 and 78 is an upper internal seal flange 81. The upper seal flanges 80 and 81 are movable, like the lower seal flanges 77 and 78, between an axially spaced open position shown in FIG. 7S and a closed position shown in FIG. 7R. Formed between the sampler body 74 and mandrel 76 and between the upper and lower seal flanges is a sampler chamber 82.

At each end of the sampler chamber 82 is a bleed port 83 and a transversely disposed bleed valve bore 84. As shown in detail in FIGS. 25 and 26, the bore 84 receives a manually operated bleed valve 85 and is provided with an internally screwthreaded socket 86 for attachment to a bleed line.

Secured to the upper end of the sampler outer sleeve 74 is an access body 87 similar to the access bodies 34 and 57 and provided with access windows 35. The upper end of the inner sampler mandrel 76 is joined by a separable connector 38 to a control sleeve 88, similar to the control sleeve 37.

The access body 87 and the upper end of the inner sampler sleeve 76 constitute the upper extremity of the sampler assembly D. The stroke actuated valve assembly E continues from the sampler assembly D and includes at its lower end an adjustable fitting 89 corresponding respectively to the fittings 7 and 36.

The adjustable fitting 89 is secured to a mandrel 91 surrounding the control sleeve 88, slidably mounted on the mandrel 91 is a lock ring sleeve 92 corresponding to the lock ring sleeve 44 and provided with an internal annular chamber to recieve a lock ring 46, the sleeve 92 is secured to a body 93. The mandrel 91 is provided with slots 52 in which fit the ends 53a of fingers 53 and which is bordered by a deflector ramp 54, all as shown in FIGS. 5S, 5R, 21 and 22.

The upper end of the body 93 is provided with internal splines 94 and the mandrel 91 above the fingers 53 is provided with external splines 95. The body 93 is joined to a body 96 having a pair of spaced internal flanges 97. Carried by the mandrel 91 near its upper end is a multisplit spring collet 98 having outwardly converging obtusely related walls, the apex 99 of which engages the internal flanges 97 to provide a resilient restraint to relative axial movement for the purpose of sensing the relative position of the body 96 and mandrel 91.

The upper end of the mandrel 91 is joined to a cam control mandrel 100 and the body 96 is joined to a body 101, which in turn, is joined to an elongated ported final body 102. The body 101 is also joined to a relatively short balance piston 103 which confronts the mandrel 100. Slidably mounted between the ported body 102 and balance piston 103 is a balance cylinder 104. A spring 105 urges the cylinder toward an extended position relative to the balance piston 103. The upper end of the balance cylinder 104 is secured to a rotary block valve carrier sleeve 106 confronting the final body 102.

Figure 27:
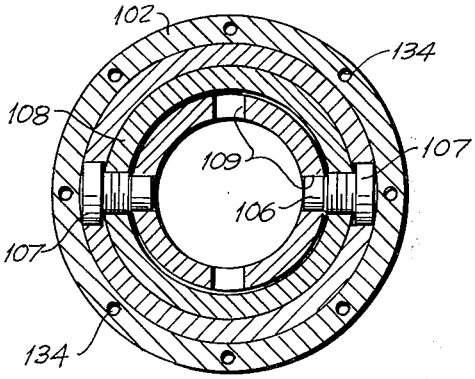
FIG. 27 is an enlarged transverse sectional view taken through 27—27 of FIG. 9S.

Adjacent the balance piston 103, the carrier sleeve 106 receives the radially outer ends of a set of alignment screw pins 107, which are mounted radially in a retainer ring 108. The cam control mandrel 100 is provided with a set of elongated longitudinal slots 109 which receive the radially inner ends of the screw pins 107 as shown in FIG. 27. The mandrel 100, which is fixed against rotation, secures the rotary block valve carrier sleeve 106 against rotation by means of the screw pins 107. The mandrel 100, however, is by reason of the longitudinal slots 109, capable of substantial axial movement.

Figure 30:
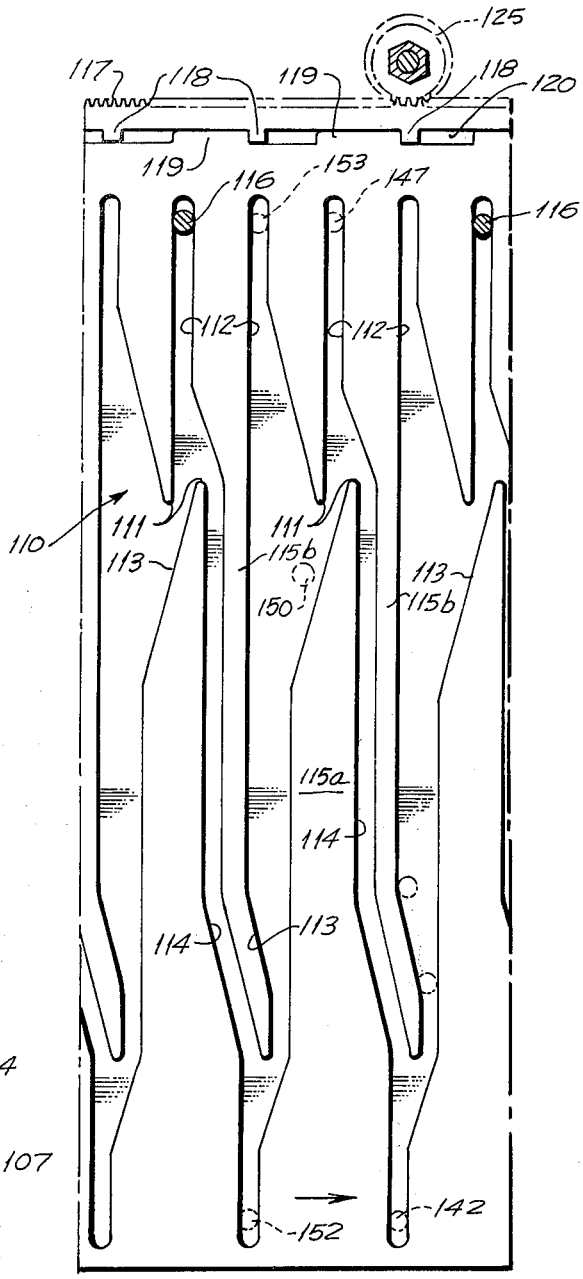
FIG. 30 is a developed view of a cam unit for control of a rotary valve utilized in the testing tool.
Figure 32:
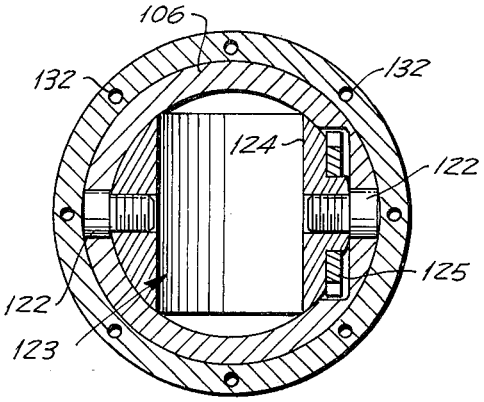
FIG. 32 is an enlarged transverse sectional view taken through 32—32 of FIG. 10S showing the rotary block valve.

Located between the mandrel 100 and the rotary block valve carrier sleeve 106 is an elongated rotatable cam cylinder 110, a developed view of which is shown in FIG. 30. The cam cylinder includes axially overlapping cam tips 111 forming entrance ends to alternately disposed upwardly extending cam slots 112 and downwardly extending cam slots 113 and 114 separated by webs 115*a* and 115*b*. The upper portion of the mandrel 100 is provided with three cam pins 116 which are received in the cam slots 112. The pattern of the cam slots is such that upon relative reciprocation of the cam pins and cam slots the cam cylinder is advanced circumferentially a fixed amount according to the cam pattern.

Figure 31:
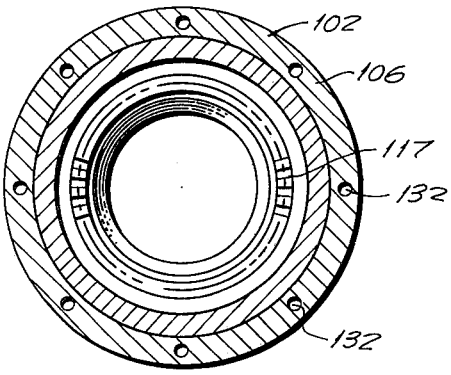
FIG. 31 is an enlarged transverse sectional view taken through 31—31 of FIG. 10S with the rotary valve omitted, showing the cam drive gear.
Figure 35:
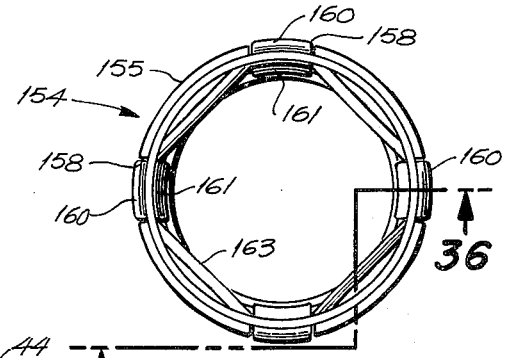
FIG. 35 is a top view of the lock ring unit.
Figure 34:
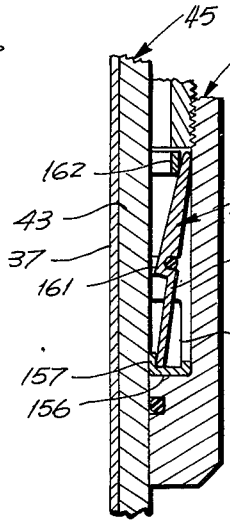
FIG. 34 is a fragmentary longitudinal half-sectional view corresponding to the region represented by FIG. 19 showing a lock ring unit interchangeable with the lock ring 46.
Figure 36:
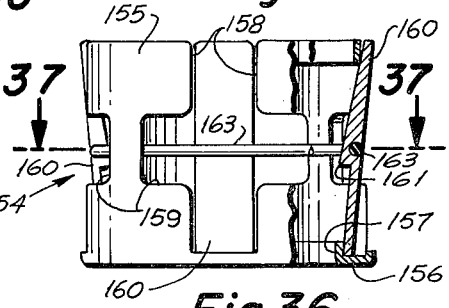
FIG. 36 is a partial side view, partial sectional view thereof taken through 36—36 of FIG. 35.

Secured to the upper end of the cam cylinder 110 is a ring gear 117 having axially extending teeth, as shown in FIGS. 30 and 31. As shown in FIG. 30, the ring gear has three drive lugs 118 which contact the cam cylinder drive faces 119. The open space 120 on the cam cylinder drive allows the cam to change the direction of rotation and rotate oppositely while the cam pins 116 pass through the cam slots 113 and return to the original rotation position through slots 121 without affecting the rotation of the ring gear 117.

Supported by journal pins 122 received in diametrical bearing apertures in the rotary block valve carrier sleeve 106 is a rotary block valve 123 having a diametrical bore 124. Secured at one side of the rotary block valve coaxial with the journal pins 122 is a driven gear 125 which is engaged by the drive gear 117, all as shown in FIGS. 10S. 10R, 30 and 32.

Figure 33:
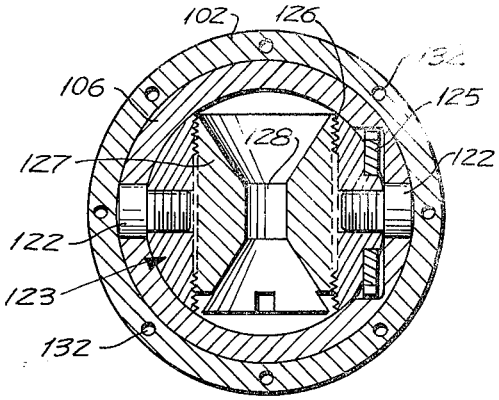
FIG. 33 is an enlarged transverse sectional view, corresponding to FIG. 32, showing a modified rotary choke valve having a removable choke core.

Alternatively, as shown in FIG. 33, the bore 124 rotary block valve 123 may be provided with internal screwthreads 126 and fitted with a choke 127 having a throat 128 of reduced diameter.

The final body 102 is joined at its upper end to a top fitting 129 which carries a seal sleeve 130 which engages the rotary block valve 123. The top fitting 129 is secured to the tubing string 1.

A bypass or pressure transmission passage is provided including radial portions 131 in the top fitting 129, which are connected to upper axial bores 132 formed in the walls of the body 102. The upper bores 132 communicate with channels 133 in the form of external grooves formed in the carrier sleeve 106, the channels 133 communicate with lower axial bores 134 in the body 102 which discharges into the chamber 135 containing the spring 105.

BYPASS DUCTS-PRESSURE BALANCE

The complete assembly of valve carrier 106 and balance cylinder 104 can slide or more axially approximately ¼inch in the ported final body 102, allowing the rotary block valve 123 to move to or from the valve seal 130. The rotary block valve 123 is held against the seal 130 by spring 105 in a dry or no pressure state.

With formation pressure in the region 136 below the rotary block valve 123, the well fluid (which may be liquid or gas or a combination thereof) enters the perforated tube 4, the rotary block valve is held closed by that pressure on the area of the valve seal 130. However, that force on the rotary block valve 123 is balanced by an opposite force on the rotary block valve carrier sleeve 106 applied to the area 137 at the upper end of the carrier sleeve 106 minus the area 138 adjacent the upper end of the balance cylinder 104 which allows the valve to open while under high pressure. This is shown in FIGS. 9S, 10S and 10R.

The bypass or pressure transmission passages 131, 132, 133, 134 and chamber 139 containing the spring 105, subject the bottom end of the balance cylinder 104 to the pressure in the region 140 above the rotary block valve 123. The area at the end of the balance cylinder is proportional to the area above the rotary block valve seal so that in the event the pressure is higher in the region 140 above the rotary block valve than the region below, the rotary block valve will be held against the valve seal 106, not allowing a back flow.

RUNNING IN

In the running in condition the testing tool is in the extended and locked position, bypass ports 30 and 32 are open, the rotary block valve 123 is closed, as shown in FIGS. 3R through 10R. The tubing string 1 and tool assembly can be pushed and pulled through a shift or tight place in the hole without cycling the testing tool and thus opening the valve because of the initial time delay and sequential interlocking mandrels and lock rings. The bypass and pressure balance system is held extended by oil in the pressure chamber 29. Interlock assembly C within the region C-C indicated in FIG. 2 is held extended by the lock ring 46 in a circumferential groove above slots 52 in the mandrel 43. The valve assembly E is held extended by the similar lock ring 46 in a groove in the mandrel 91. Interlock cam pin 68 is at either position 141 as shown in FIG. 24 holding the sampler closed as shown in 6R and 7R. The valve cam pin 116 is at position 142 with the rotary block valve closed as shown in FIG. 30.

INITIAL SETDOWN

After the packer assembly A, depicted in FIG. 1, or some other tool corresponding thereto is set, it becomes a platform or a point of fixed axial reference for the test tool system. Downward force is transmitted through the outer bodies 17 to the oil chamber 29. Oil is transferred through restricting cells 24 to the chamber 28, allowing body 26 to move down closing ports 30 and 32.

Downward movement of the outer bodies brings the fingers 53 to the control sleeve 37 which is fixed to the inner mandrels and packer. The beveled upper end 55 of sleeve 37 expands the fingers 53 radially outward raising the spring webs 47 of lock ring 46 from the groove releasing the body 45 from the mandrel 43.

When the lock ring 46 releases, the outer body of the interlock slides axially down carrying the cam sleeve 62 with it. At half of its travel cam pin 68 engages the cam sleeve 62 at midposition 148 and through the cam sleeve force the mandrel 61 relative to the downward moving outer body 56 and access body 57.

The sampler assembly D is opened to receive a well fluid sample by the movement and operation of the interlock assembly C. As mandrel 61 moves connected sampler mandrels 73 and 76 move relative to outer bodies 72, 74 and 87. This shown in FIGS. 6S, 7S, 6R and 7R.

When the rotary block valve 123 is opened, a portion of the flow will be diverted at the lower slots 75 from the full bore inside diameter through the sample chamber 82 and returned to the central flow, at the upper slots 79. The flow is diverted at the lower entrance slot 75 by the hydrodynamic principle of an increasing taper bore 143 allowing the fluid velocity to decrease through in this region and an abrupt reduction of area at 144 past the angular upward diverging slots 75 which decreases the fluid pressure and increases flow, thereby exerting a force directing the fluid into the sampler chamber.

Similarly at the upper end of the sampler assembly an increasing taper 145 allows the fluid velocity to decrease and an abrupt neck in the bore causes the velocity to increase through the slots 79 causing flow back into the main central flow from the sample chamber The downward movement of the outer bodies of the interlock and assembly C sampler assembly D causes the control sleeve 88 to move relative to the body and causes fingers 53 and lock ring 46 in mandrel 91 to release the valve assembly E from the locked extended condition.

Unlocked, the outer body 96, 101 and 102 move down relative to the cam control mandrel 100 and cam pins 116 carrying the valve and cam assembly. From the extended position 142, with the rotary block valve closed, the cam pin 116 moves in cam slot 114 to position 147 rotating the cam clockwise, driving ring gear 117 and turning rotary block 123 from the closed to open position.

VALVE OPERATION-HALF STROKE

The rotary block valve is opened by a full set down stroke as previously indicated. The rotary block valve is closed by either a full up strain stroke or a half stroke up and set down.

In a half stroke the tubing 1 is lifted, moving the valve body upward until the upper internal flange 97 contacts the spring collet 98, as shown in 9S. Continued lifting moves the interlock assembly body causing the cam pin 68 to move from the position 148 to position 149 in the first half of its travel and in the second half of the travel the cam pin 68 engages the cam at 149 pulling it, the housing, the upper mandrel 61 and the connected sampler inner mandrels 73 and 76. Thus the sampler is closed while the well formation is still flowing through the open valve.

The interlock assembly is stopped at full travel by the shoulder 51a on the mandrel against the internal spline 50 as shown in FIG. 5R. Further increased up string on the tubing string pulls collet 98 through two internal flanges 97 showing a noticeable increase on the weight indicator at the surface. The valve cam pin 116 has moved from position 147 to position 150.

After this indication of position is observed, movement is reversed and the tubing string is set down.

Momentarily stopped by the collet 98 at the lower internal flange 97 in the valve assembly, the set down motion first moves the cam pin 68 from position 149 through cam slot 64 to position 151. Because of the long slot 64, neither the cam, the housing, nor the upper mandrel circumferentially.

The set down motion secondarily moves the valve collet 98 through the two flanges 97 and the cam pin 116 from position 207 rotating the cam 110 and ring gear 117 turning the rotary block valve closed.

As the cam slots are continuous around the cam 110, the ring gear 117 rotates in one direction only and thus the rotary block valve revolves in one direction 90 degrees with each stroke. In the event that debris or foreign matter too large to pass lodge in the open valve or its choke 135 on the up stream side the tool is cycled twice revolving the rotary block valve 180 degrees. This allows the valve or choke to constantly clear itself of debris.

VALVE OPERATION-UNSTABLE BOTTOM HOLE

In the event the packer slips down the hole due to an unstable bottom at 3, while the valve is open or closed, the tool extends either by the bottom moving down at 7 or an unstroke on the tubing string 1 to the initial setdown condition with the rotary block valve closed and the valve cam pin in position 152. The testing tool system can again be set down against a stable bottom and testing continued.

VALVE OPERATION-FULL STROKE

Normally following a halfstroke to close the rotary block valve when the tubing string 1 is in a setdown condition, the tool is full stroked to open the rotary block valve and sampler and leave the tool in a setdown condition.

As the tubing string is lifted the interlock assembly cam pin 68 moves from position 151 to 141 as shown in FIG. 24, with no change to the closed samplers. The valve assembly cam pin 116 moves from position 153 to 152 as shown in FIG. 30, with no rotation of the ring gear 117 as the cam cylinder drive lugs 118 move into the space 120. The valve lock ring 46 engages the groove in mandrel 91 locking the valve assembly in its extended position.

Upon reaching the end of travel the tubing string is set down operating the interlock assembly to open the sampler to release the valve lock ring and open the rotary block valve as in the initial set down.

LIFT OFF

The testing tool assembly is brought up out of the hole by lifting the tubing string 1 after a half stroke when the rotary block valve is closed. As in the full stroke the tool extends, the sampler chambers remain closed, the rotary block valve remains closed and the valve locks extended. The weight of the packer and strain of pulling the packer assembly A free from the hole forces the oil in chamber 28 through the restricting cells 24 into chambers 29, as shown in FIG. 3S. The extension of the bypass assembly B opens the bypass ports and locks the interlock assembly, thus allowing the tool assembly to be pushed and pulled through a constriction in the well bore without opening the valve or losing the sample.

Figure 37:
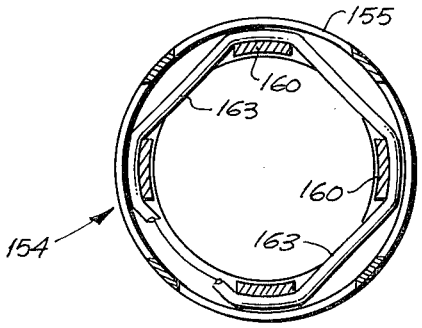
FIG. 37 is a transverse sectional view thereof taken through 37—37 of FIG. 36.

Referring to FIGS. 34 through 37, a lock ring unit 154 is illustrated which may be substituted for the lock ring 46. The lock ring unit 154 includes cylindrical cage 155 including an internal bottom flange 156 having an upturned inner rim 157 and vertical slots 158. The slots are circumferentially enlarged at their midportions as indicated by 159. The slots 158 receive a set of compression fingers 160, each having an internally projecting boss 161. The lower ends of the fingers 160 are retained by the rim 157. The upper end of the cage is provided with an internal band 162 bridging the slots 159, the bridging portions being engaged by the upper portions of the fingers 160. Each finger 160 is provided externally at its midpoint with a transverse groove which receives a retainer 163 which is disposed internally of the cage 155 as shown in FIG. 37.

Having fully described my invention it is to be understood that I am not to be limited to the details herein set forth, but that my invention is of the full scope of the appended claims.

I claim:

1. A tubing string supported well testing tool, comprising:

a. a tubular structure having a series of control subassemblies, each having components capable of limited relative axial movement;

b. a tubular packer suspended from the tubular structure and adapted to be set in a well core;

c. a first of the control subassemblies having radially directed ports, said ports occupying an open position during movement of the tubular structure and packer through the well bore to permit passage of well fluid through the packer into the region surrounding the tubing string, said ports occupying closed positions when the packer is set in the well bore;

d. a rotatable main valve within the tubular structure;

e. a second of the control subassemblies for moving the valve successively between a position closing flow through the tubular structure and a position permitting flow through the packer and tubular structure;

f. said second control assembly including a driven gear carried by the main valve, an annular gear carried within the walls of the tubular structure, a multiple cam cylinder having a drive gear engagable with the the driven gear, longitudinally and circumferentially extending cam elements, and longitudinally movable cam driving elements for turning the cam cylinder to effect rotation of the main valve;

g. and a pressure counterbalancing means, operable when the main valve is closed and the well pressure below the main valve exceeds the pressure above, for applying a counter-force to facilitate movement of the main valve to its open position.

2. A well testing tool, as defined in claim 1, wherein:

a. the tubing structure components define therebetween a longitudinally extending annular well fluid sampler chamber disposed below the main valve and including valve elements at its upper and lower extermities for exposing the sampler chamber to flow of fluid to and through the main valve;

b. said valve elements being actuated to open and close the sampler chamber by operation of said cam cylinder and its driving elements.

3. A well testing tool, as defined in claim 2, wherein:

a. means at the lower extremity of the sampler chamber for creating a force deflecting fluid into the sample chamber;

b. and means at the upper extremity of the sampler chamber for creating a force deflecting fluid from the sampler chamber.

4. A tubing string supported well testing tool, comprising:

a. an inner tubular structure, defining a central flow passage;

b. an outer tubular structure surrounding the inner tubular structure, the tubular structures being capable of limited relative longitudinal movement;

c. said tubular structures defining therebetween a longitudinally extending annular sampler chamber;

d. valve means at the lower end of the sampler chamber for receiving, when open, a portion of the fluid flowing upward within the central flow passage;

e. valve means at the upper end of the sampler chamber, operable, when open, on filling the sampler chamber, to return excess fluid from the sampler chamber to the central flow passage;

f. and valve actuating means responsive to a predetermined relative longitudinal movement of the tubular structures for opening and closing the sampler chamber.

5. A well testing tool, as defined in claim 4, wherein:

a. said fluid receiving means is contoured to produce a force drawing fluid from the central flow passage into the lower end of the sampler chamber;

b. said fluid returning means is contoured to produce a force drawing fluid from the upper end of the sampler chamber to the central flow passage.

6. A well testing tool, as defined in claim 4, wherein:

a. a central valve means is provided in the inner tubular structure above the sampler structure for opening and closing the central flow passage;

b. said valve actuating means, also being operable to open and close said central valve means, and to maintain said central valve means open during flow of fluid through the sampler chamber.

* * * * *